US009397483B2

(12) United States Patent
Muramoto et al.

(10) Patent No.: US 9,397,483 B2
(45) Date of Patent: Jul. 19, 2016

(54) IGNITION DEVICE

(71) Applicant: Mitsubishi Electric Corporation, Tokyo (JP)

(72) Inventors: Yuichi Muramoto, Tokyo (JP); Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/668,337

(22) Filed: Mar. 25, 2015

(65) Prior Publication Data

US 2016/0164263 A1 Jun. 9, 2016

(30) Foreign Application Priority Data

Dec. 4, 2014 (JP) ..... 2014-245551

(51) Int. Cl.
*H01T 15/00* (2006.01)
*F02P 5/145* (2006.01)

(52) U.S. Cl.
CPC ..... *H01T 15/00* (2013.01); *F02P 5/145* (2013.01)

(58) Field of Classification Search
CPC ..... B60W 10/06; B60W 10/08; B60W 10/26; F02P 5/145; F02P 9/007; F02P 3/01; F02P 23/04; F02P 3/02; F02P 13/00; F02P 15/10; F02P 9/002; F02D 29/06; F02D 41/021; F02D 37/02; F02D 41/062; F02D 31/003; H01T 13/50; H01T 13/20; H01T 13/40; H01T 15/00; H01T 13/04; H01T 13/06; H01T 13/08; H01T 13/16; H01T 13/34
See application file for complete search history.

(56) References Cited

U.S. PATENT DOCUMENTS

| | | | | |
|---|---|---|---|---|
| 3,567,993 | A * | 3/1971 | Sturm | H05B 41/04 315/112 |
| 6,550,463 | B1 * | 4/2003 | Schmolla | F02P 3/005 123/605 |
| 2007/0132402 | A1 * | 6/2007 | Kitta | H05B 41/04 315/291 |
| 2013/0214689 | A1 * | 8/2013 | Katsuraya | F02P 9/007 315/174 |

FOREIGN PATENT DOCUMENTS

JP 2012-112310 A 6/2012

* cited by examiner

*Primary Examiner* — Jany Richardson
(74) *Attorney, Agent, or Firm* — Sughrue Mion, PLLC; Richard C. Turner

(57) ABSTRACT

In an ignition device, at a timing of a control signal provided by a control device to control an ignition coil device or at a timing prior to the control signal in order that a high voltage is applied to an ignition plug to initiate a spark discharge, a control circuit of an AC power source unit in response to the control signal controls switching elements composing a bridge circuit in the AC power source unit for a DC-AC inversion to thereby short-circuit a winding of a transformer device on the side of the AC power source unit, connected between a boosting device including a capacitor device and the bridge circuit for the circulation of a capacitance discharging current from the boosting device to the transformer device.

14 Claims, 4 Drawing Sheets

IGNITION DEVICE

BACKGROUND OF THE INVENTION

1. Field of the Invention

The present invention relates to an ignition device and in particular to an ignition device for high frequency discharge, used in the operation of an internal combustion engine.

2. Description of the Related Art

In recent years, problems of environmental conservation or fuel depletion have been posed, and there is a pressing need even in the automobile industry for countermeasures for those problems. As one example of such countermeasures, there is a method of improving fuel consumption dramatically by down-sizing and reducing weight of engines using superchargers.

It has been known that in a highly supercharged state, the pressure in the combustion chamber of an engine becomes very high even in a state where combustion has not started and that a spark discharge for starting the combustion is difficult to initiate. One of the reasons is that the voltage required to cause an insulation breakdown at the gap between the high voltage side electrode and the ground side electrode of an ignition plug becomes very high, exceeding the breakdown voltage of the insulator portion of the ignition plug.

Although research for increasing the breakdown voltage of the insulator portion to solve this problem has been made, it is difficult actually to secure a sufficient breakdown voltage for the requirement and there is no other choice but to adopt means for narrowing the gap of the ignition plug.

However, narrowing the gap of the ignition plug will instead expand the quenching action at the electrode, causing another problem of reduction in start-up performance and combustion performance.

For solving this other problem, an ignition device provided with means to avoid such problem as by supplementing energy in excess of the quenching action, i.e. thermal energy absorbed by the electrode with a spark discharge, or for inducing combustion at a portion even just a little removed from the electrode has been proposed as described in e.g. Patent Document 1 (Japanese Patent Application Laid-open No. 2012-112310).

The ignition device disclosed in Patent Document 1 above enables the spark discharge to be initiated at the gap of the ignition plug by means of a conventional ignition coil and a high frequency current made to flow in the path of the spark discharge via a mixing portion including a capacitor, thereby forming a discharge plasma that is a spark discharge of high energy and that further extends over a wider area than a conventional spark discharge.

SUMMARY OF THE INVENTION

While the prior art ignition device disclosed in the above noted Patent Document 1 is a system of having a high frequency current flow into the ignition plug through a high breakdown voltage capacitor, at the moment when the spark discharge arises, a capacitance discharging current flows into an AC power source unit from a high breakdown voltage capacitor, causing an excessive voltage and an excessive current to be generated within the AC power source unit, damaging the circuit, and degrading the reliability.

The present invention taking account of such a problem is aimed at providing an ignition device, in which even at the moment when the spark discharge occurs, a capacitance discharging current does not flow from the high breakdown voltage capacitor into an AC power source unit.

For achieving the above object, an ignition device according to the present invention comprises: an ignition plug that ignites a combustible gas mixture in a combustion chamber of an internal combustion engine; an ignition coil device that applies a DC (Direct Current) high voltage to the ignition plug to initiate a spark discharge; an AC (Alternating Current) power source unit that generates an AC current to be inputted to a path of the spark discharge; a boosting device, composed of a capacitor device and an inductor device, that boosts the AC current outputted from the AC power source unit and supplies the AC current boosted to the ignition plug; and a control device that controls operations of the ignition coil device and the AC power source unit; wherein the AC power source unit includes a bridge circuit for a DC-AC inversion composed of a plurality of switching elements, a transformer device connected between the boosting device and the bridge circuit, and a control circuit that controls the switching elements at a timing of a control signal from the control device to control the ignition coil device or at a timing prior to the control signal in order that a high voltage is applied to the ignition plug to initiate the spark discharge, to thereby short-circuit a winding of the transformer device on a side of the AC power source unit.

According to the ignition device of the present invention, the generation of an excessive voltage within the AC power source unit due to a capacitance discharging current flowing into the AC power source unit at the moment when a spark discharge occurs can be avoided, so that a breakdown of the circuit in the AC power source unit can be prevented and the reliability of the ignition device can be enhanced.

Also, a voltage arising within the AC power source unit can be suppressed, so that a low cost element with low breakdown voltage as a switching element included in the AC power source unit can be employed and a cost reduction can be ensured.

DETAILED DESCRIPTION OF THE PREFERRED EMBODIMENT

Figure 1:
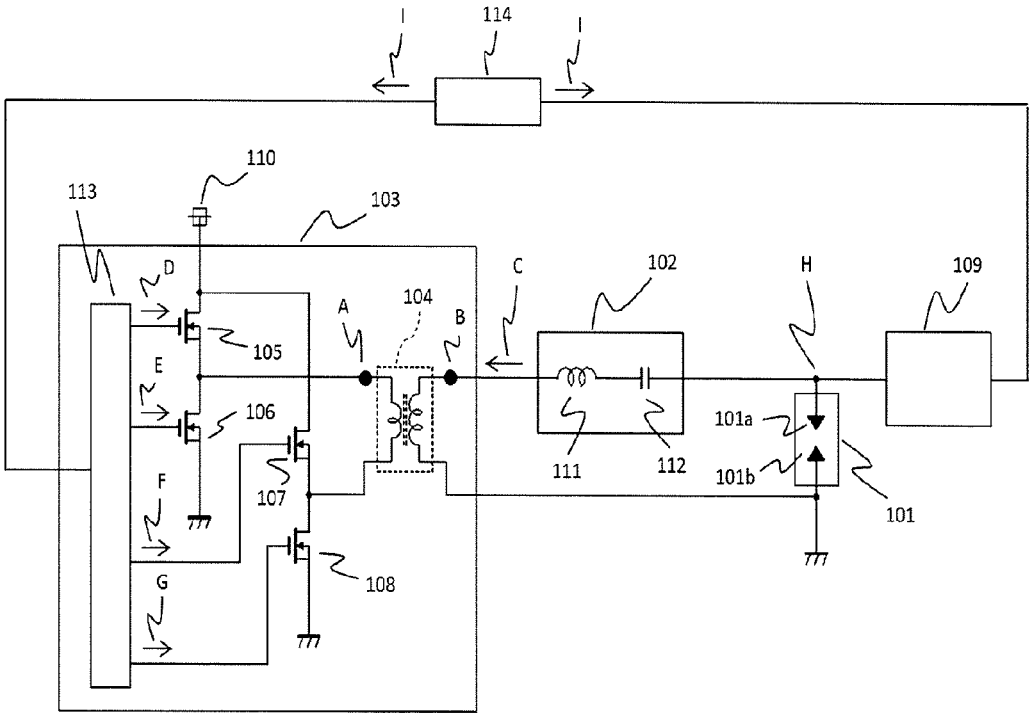
FIG. 1 is a block diagram of a circuit arrangement of an ignition device according to Embodiment 1 of the present invention.

In the following, preferred embodiments of an ignition device according to the present invention will be described referring to the drawings.

Embodiment 1

The ignition device according to the present invention is one which prevents a circuit of an AC power source unit from breaking down due to a capacity discharging current flowing from a capacitor into the AC power source unit (e.g. inverter device), at the moment when a spark discharge arises at a main plug gap of an ignition plug by a high voltage produced by an ignition coil device (e.g. DC power source unit).

For this purpose, the ignition device includes, as shown in FIG. 1, an ignition plug 101 for igniting a combustible gas mixture within a combustion chamber of an engine, an ignition coil device 109 for applying a high voltage to the ignition plug 101 to initiate a spark discharge, an AC power source unit 103 for generating an AC current to flow in a path of the spark discharge, a boosting device 102, composed of a coil device 111 and a capacitor device 112, for boosting the output voltage of the AC power source unit 103 at an LC resonance point produced by the coil device 111 and the capacitor device 112 to be supplied to the ignition plug 101 for the generation of discharging plasma, and a control device 114 for controlling output generation timings of the ignition coil device 109 and the AC power source unit 103.

The AC power source unit 103 includes a bridge circuit for DC-AC inversion, composed of two pairs of switching elements (e.g. MOS-FET) 105, 106 and 107, 108 respectively connected in series between a high voltage side terminal and a low voltage side terminal of a DC voltage source 110, a control circuit 113, under the control of the control device 114, for turning the switching elements of the bridge circuit ON/OFF based on the timing when the ignition coil device 109 initiates a spark discharge, and a transformer device 104 of which primary winding is connected to each connection point of each pair of the switching elements and of which secondary winding is connected to the coil device 111 of the boosting device 102.

In the operation of the ignition device according to the present invention shown in FIG. 1, by the output signal (shown by a waveform I in FIGS. 2 and 3) from the control device 114, energy (shown by a waveform H therein) is supplied from the ignition coil device 109 using a DC power source to the spark discharge path of the ignition plug 101, thereby initiating a spark discharge between the electrodes 101*a*-101*b*. Then, a high frequency current flows from the AC power source unit 103 into the ignition plug 101 through the boosting device 102 composed of the capacitor device 112 and the inductor device 111 to initiate the plasma discharge between the electrodes 101*a*-101*b*.

It should be noted that the capacitor device 112 of the boosting device 102 is to be charged by an induction current which is the output of the ignition coil device 109 and the electric charges charged in the capacitor device 112 are discharged (as shown by a waveform C therein) toward the AC power source device 103 at the moment that a spark discharge is initiated at the ignition plug 101.

Figure 2:
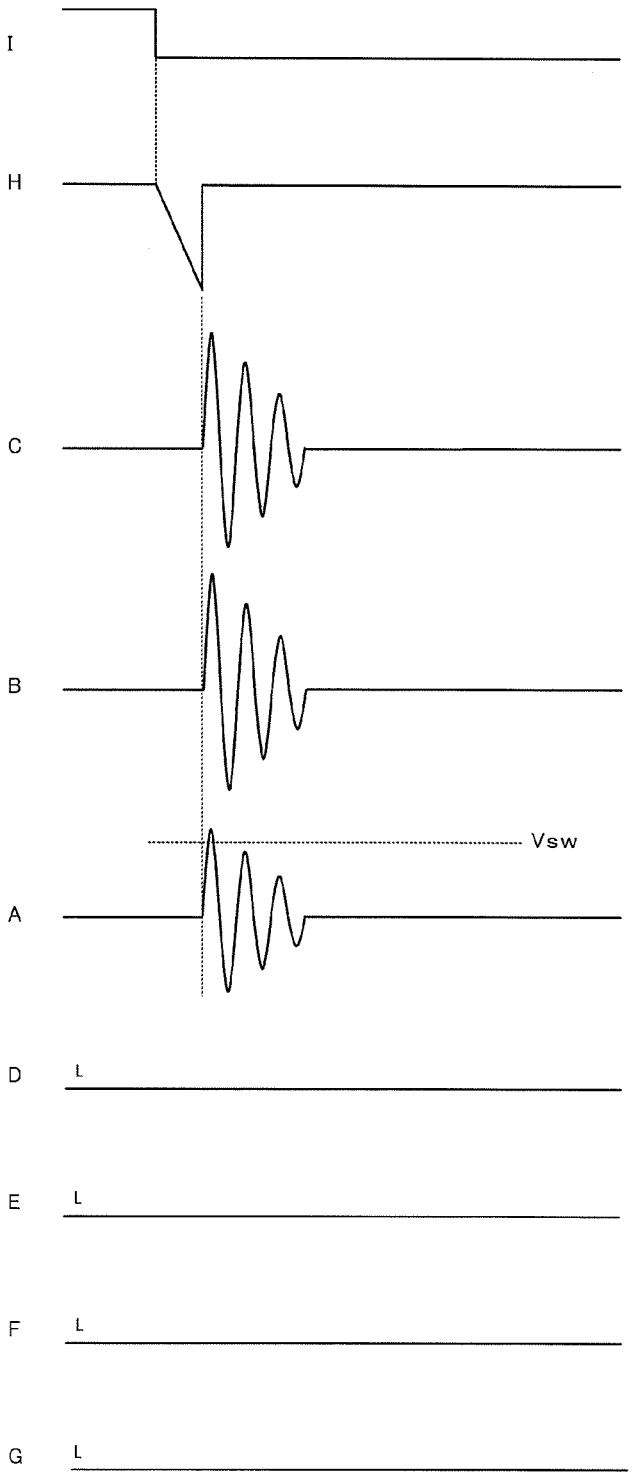
FIG. 2 is an operation timing chart showing one example (assumed example) in which an excessive voltage arises within an AC power source unit in the ignition device shown in FIG. 1.

Here, if gate signals D-G respectively for the switching elements 105-108 within the AC power source device 103 are assumed to be preliminarily controlled OFF by the control circuit 113 as shown by the example (assumed example) in FIG. 2, the capacitance discharging current C flowing into the AC power source unit 103 from the capacitor device 112 will reach a point B of the secondary winding of the transformer device 104 through the inductor device 111 and then a point A of a primary winding of the transformer device 104, generating an excessive voltage over a switching element breakdown voltage Vsw.

Therefore, in the state where the switching elements 105-108 are kept OFF, an excessive voltage at the point A is applied between the drain terminal (in case of MOS-FETs being used, the same being applied in the following) of the switching element 106 and the drain terminal of the switching element 108, incurring the breakdown of the switching elements.

Figure 3:
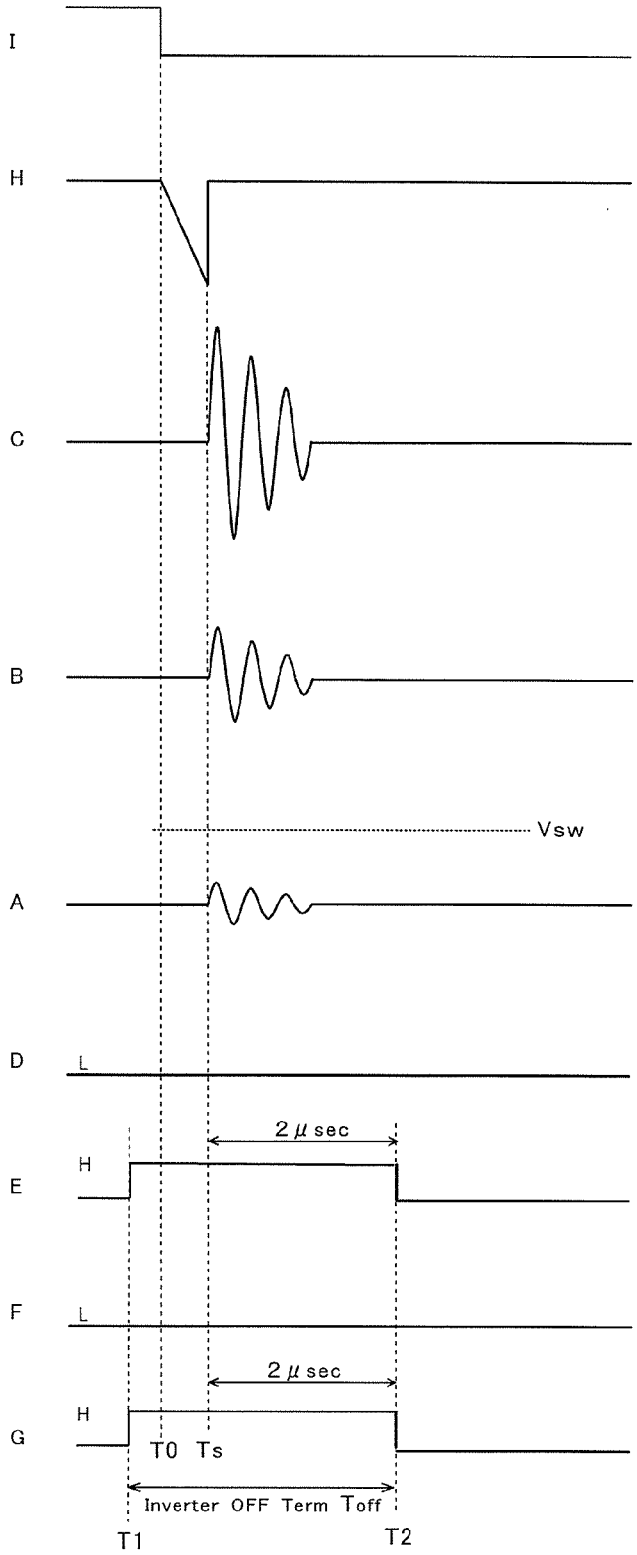
FIG. 3 is an operation timing chart within the AC power source unit of the ignition device according to Embodiment 1 of the present invention.

For solving such a problem, the ignition device of Embodiment 1 performs ON/OFF control of the switching elements by the timings shown in FIG. 3.

Namely, when the capacitance discharging current C flows into the AC power source unit 103 from the capacitor device 112, within the AC power source unit 103, the switching elements 106 and 108 with source terminals connected to the low voltage side of the DC voltage source 110 are turned ON respectively by the gate signals E and G from the control circuit 113 while the switching elements 105 and 107 with drain terminals connected to the high voltage side of the DC voltage source 110 are turned ON respectively by the gate signals D and F from the control circuit 113, thereby short-circuiting the side of the point A (hereinafter, abbreviated as the point A side) of the transformer device 104, i.e. short-circuiting the primary winding of the transformer device 104.

It is to be noted that as a method of turning the switching elements 106 and 108 ON and short-circuiting the point A side of the transformer device 104, not only short-circuiting the drain terminals of the switching elements but also short-circuiting them through ground may be made, as seen from FIG. 1.

Also, turning the switching elements 106 and 108 OFF and turning the switching elements 105 and 107 with drain terminals connected to the high voltage side, ON can short-circuit the point A side (primary winding) of the transformer device 104, whereby the same effect as in the case where the switching elements 106 and 108 are turned ON is achieved.

In the state where the point A side of the transformer device 104 is short-circuited, the voltage arising on the side of the point B (hereinafter, abbreviated as the point B side) of the transformer device 104 has only a voltage corresponding to a leakage inductance component on the point B side, where the leakage inductance component is low enough, compared with the coil inductance component, that the voltage arising on the point B side can be significantly reduced.

Also, the voltage arising on the point A side of the transformer device 104 has a very low voltage that is below the breakdown voltage Vsw of the switching element when the switching elements 106 and 108 are turned ON and so the point A side is short-circuited to ground, thereby preventing the switching elements from breaking down.

Namely, the energy flowing into the AC power source unit 103 from the capacitor device 112 within the boosting device 102 makes the AC current C corresponding to the LC resonance frequency of the capacitor device 112 and the inductor device 111 flow into the AC power source device 103 and flow on the point B side of the transformer device 104, so that an AC current corresponding to the turn ratio generates a negligible voltage on the point A side of the transformer device 104, where this voltage is very small below the breakdown voltage Vsw of the switching element such that the breakdown of the switching element can be prevented.

It should be noted that if the wiring distances between the transformer device 104-the capacitor device 106 and between the transformer device 104-the switching element 108 are elongated, the impedance component of the wiring is increased, and in turn the voltage generated by the impedance of the wiring with the AC current arising on the point A side of the transformer device 104 is increased, and there is a fear that a voltage above the breakdown voltage Vsw of the switching element will be generated. Therefore, it is preferable to make the wiring between the transformer device 104-the capacitor device 106 and between the transformer device 104-the switching element 108 the shortest possible.

With respect to the time interval for keeping the switching element ON, the period of the capacitance discharging current C flowing into the AC power source unit 103 is on the order of 2 microseconds or less, so that as shown in FIG. 3, the ON period of the control signals E and G requires at least 2 microseconds from a spark discharge initiation time Ts where the voltage of the waveform H rapidly lowers.

On the other hand, the timing of turning the switching elements 106 and 108 ON, i.e. the time point of the control signals E and G being turned ON is not only the spark discharge initiation time Ts as noted above but also may be the time immediately after the completion of the supply of the AC current (inverter operation) from the AC power source unit 103 or the time after a lapse of a predetermined time from the completion of the supply. The latter case is applied to prevent the occurrence of excessive voltage even when the capacitance discharging current C flows at an unintentional timing due to a malfunction of the ignition coil device 109. This is a time point T1 shown in FIG. 3.

Also, when the switching elements 106 and 108 are kept ON during the operation period of the AC power source unit 103, the generation of the AC current (inverter operation) cannot be performed, so that when the AC power source unit 103 restarts the inverter operation, the ON state of the switching elements 106 and 108 must have completely finished. This is a time point T2 shown in FIG. 3.

Accordingly, the period while the AC power source unit 103 is free from the inverter operation is Toff=T2−T1 as shown in FIG. 3, where T1 may be the time point T0 at which the control device 114 instructs to initiate the spark discharge by the control signal to the ignition coil device 109, as described above. Namely, at the same timing as the timing (T0) at which the ignition coil device 109 in response to the control signal from the control device 114 starts to generate the spark discharge at the ignition plug 101 or at a timing (T1) prior to the above timing (T0), the switching elements are controlled to short-circuit the winding of the transformer device 104 on the side of the AC power source unit 103, whereby the capacitance discharging current is circulated from the boosting device 102 to the transformer device 104.

Thus, the control signals D-G from the control circuit 113 achieve, based on the signal I from the control device 114, the operations of driving the switching elements for a fixed time interval or driving the switching elements from the inverter operation finish timing T1 of the AC power source unit 103 to the next inverter operation start timing T2 of the AC power source unit 103.

Furthermore, the control circuit 113 may also control the bridge circuit so that the AC power source unit 103 does not restart the DC-AC inversion until a time obtained from a prestored memory map composed of at least one of a predetermined time and a rotational speed or load of the internal combustion engine elapses from the above timing.

Embodiment 2

While the bridge circuit of the AC power source unit 103 has been described above and illustrated in the drawings with the arrangement of a full bridge circuit with respect to the effect for the switching elements on the lower voltage side being made ON in Embodiment 1 of the present invention, the arrangement of the bridge circuit may also be that of a half bridge circuit.

Figure 4:
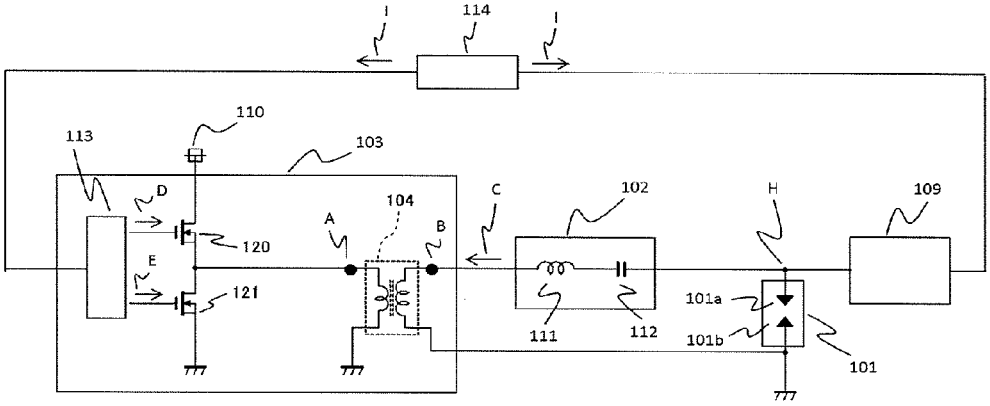
FIG. 4 is a block diagram of a circuit arrangement of an ignition device according to Embodiment 2 of the present invention.

Describing this by referring to FIG. 4, this half bridge circuit is composed of one pair of switching elements 120 and 121 connected in series between the high voltage side terminal and the low voltage side terminal of the DC voltage source 110, in which the winding of the transformer device 104 on the side of the AC power source unit 103 is connected between the connection points of the switching elements 120, 121 and ground, i.e. between the anode-cathode of the switching element 121.

In operation, when the capacitance discharging current C flows from the capacitor device 112 into the AC power source device 103, within the AC power source unit 103, the control circuit 113 turns the switching element 121 ON and the switching element 120 OFF to short-circuit the winding of the point A side of the transformer device 104 through ground, thereby preventing an excessive voltage being generated to the switching elements 120 and 121.

Also in this half bridge circuit arrangement, the voltage applied across both terminals of the switching element is determined by the wiring distance between the switching element 121 on the lower side and the transformer device 104, so that it is preferable to make the wiring distance as short as possible.

Further, it goes without saying that a plurality of switching elements connected in parallel may also be used for each switch element in the bridge circuit of the present invention.

According to Embodiment 2 of the present invention, as aforementioned, the voltage generated on the side of the points A and B of the transformer device 104 can be suppressed, so that breakdown of the AC power source unit 103 can be prevented.

What is claimed is:

1. An ignition device comprising:

an ignition plug that ignites a combustible gas mixture in a combustion chamber of an internal combustion engine;

an ignition coil device that applies a DC (Direct Current) high voltage to the ignition plug to initiate a spark discharge;

an AC (Alternating Current) power source unit that generates an AC current to be inputted to a path of the spark discharge;

a boosting device, composed of a capacitor device and an inductor device, that boosts the AC current outputted from the AC power source unit and supplies the AC current boosted to the ignition plug; and a control device that controls operations of the ignition coil device and the AC power source unit; wherein the AC power source unit includes a bridge circuit for a DC-AC inversion composed of a plurality of switching elements, a transformer device connected between the boosting device and the bridge circuit, and a control circuit that controls the switching elements at a timing of a control signal from the control device to control the ignition coil device or at a timing prior to the control signal in order that a high voltage is applied to the ignition plug to initiate the spark discharge, to thereby short-circuit a winding of the transformer device on a side of the AC power source unit.

2. The ignition device according to claim 1, wherein the bridge circuit comprises a full bridge circuit having a first and a second pair of switching elements respectively connected in series between a terminal of a high voltage side and a terminal of a low voltage side of a DC voltage source, in which the winding of the transformer device on the side of the AC power source unit is connected between a connection point of the first pair of switching elements and a connection point of the second pair of switching elements, and the control circuit controls, at the timing of the control signal or at the timing prior to the control signal, the first and the second pair of switching elements on the high voltage side to an ON state and controls the first and the second pair of switching elements on the low voltage side to an OFF state, or controls, at the timing of the control signal or at the timing prior to the control signal, the first and the second pair of switching elements on the low voltage side to an ON state and controls the first and the second pair of switching elements on the high voltage side to an OFF state.

3. The ignition device according to claim 1, wherein the bridge circuit comprises a half bridge circuit having a pair of switching elements connected in series between a terminal of a high voltage side and a terminal of a low voltage side of a DC voltage source, in which the winding of the transformer device on the side of the AC power source unit is connected between a connection point of the pair of switching elements and the terminal of the low voltage side, and the control circuit controls, at the timing of the control signal or at the timing prior to the control signal, the pair of switching elements on the low voltage side to an ON state and controls the pair of switching elements on the high voltage side to an OFF state.

4. The ignition device according to claim 2, wherein the low voltage side is ground.

5. The ignition device according to claim 3, wherein the low voltage side is ground.

6. The ignition device according to claim 1, wherein the control circuit controls the switching elements to the ON state during at least 2 microseconds from that timing.

7. The ignition device according to claim 2, wherein the control circuit controls the switching elements to the ON state during at least 2 microseconds from that timing.

8. The ignition device according to claim 3, wherein the control circuit controls the switching elements to the ON state during at least 2 microseconds from that timing.

9. The ignition device according to claim 1, wherein the control circuit controls the switching elements to the ON state immediately after or in a lapse of a predetermined time after the AC power source unit has finished the DC-AC inversion to thereby short-circuit the winding of the transformer device on the side of the AC power source unit.

10. The ignition device according to claim 2, wherein the control circuit controls the switching elements to the ON state immediately after or in a lapse of a predetermined time after the AC power source unit has finished the DC-AC inversion to thereby short-circuit the winding of the transformer device on the side of the AC power source unit.

11. The ignition device according to claim 3, wherein the control circuit controls the switching elements to the ON state immediately after or in a lapse of a predetermined time after the AC power source unit has finished the DC-AC inversion to thereby short-circuit the winding of the transformer device on the side of the AC power source unit.

12. The ignition device according to claim 1, wherein the control circuit controls the bridge circuit so that the AC power source unit does not restart the DC-AC inversion until a time obtained from a prestored memory map composed of at least one of a predetermined time and a rotational speed or a load of the internal combustion engine elapses from that timing.

13. The ignition device according to claim 2, wherein the control circuit controls the bridge circuit so that the AC power source unit does not restart the DC-AC inversion until a time obtained from a prestored memory map composed of at least one of a predetermined time and a rotational speed or a load of the internal combustion engine elapses from that timing.

14. The ignition device according to claim 3, wherein the control circuit controls the bridge circuit so that the AC power source unit does not restart the DC-AC inversion until a time obtained from a prestored memory map composed of at least one of a predetermined time and a rotational speed or a load of the internal combustion engine elapses from that timing.

* * * * *